US007422065B1

(12) United States Patent
Wintill et al.

(10) Patent No.: US 7,422,065 B1
(45) Date of Patent: Sep. 9, 2008

(54) SYSTEM FOR CONTROLLING ZONES OF FLUID IN AND OUT OF A WELLBORE

(75) Inventors: Charles David Wintill, Houston, TX (US); Rodney Wayne Long, Cypress, TX (US); William Ryle Darnell, St. Martinville, LA (US); William John Darnell, Houston, TX (US); Michael Chad Darby, Katy, TX (US)

(73) Assignee: PetroQuip Energy Services, LLP, Houston, TX (US)

( * ) Notice: Subject to any disclaimer, the term of this patent is extended or adjusted under 35 U.S.C. 154(b) by 0 days.

(21) Appl. No.: 11/742,343

(22) Filed: Apr. 30, 2007

(51) Int. Cl.
*E21B 34/14* (2006.01)

(52) U.S. Cl. ..... 166/332.1; 166/319; 166/332.7; 166/373; 166/334.1

(58) Field of Classification Search ..... 166/319, 166/324, 332.1, 332.7, 373, 334.1
See application file for complete search history.

(56) References Cited

U.S. PATENT DOCUMENTS 5,664,629 A * 9/1997 Maitland ..... 166/373
6,189,619 B1 * 2/2001 Wyatt et al. ..... 166/332.1
6,237,683 B1 * 5/2001 Pringle et al. ..... 166/66
6,302,203 B1 * 10/2001 Rayssiguier et al. ... 166/250.01
6,782,948 B2 * 8/2004 Echols et al. ..... 166/278
6,983,796 B2 * 1/2006 Bayne et al. ..... 166/278
7,252,437 B2 * 8/2007 Ringgenberg ..... 385/53
2001/0040030 A1 * 11/2001 Lerche et al. ..... 166/63
2002/0084075 A1 * 7/2002 Johansen ..... 166/319
2004/0159445 A1 * 8/2004 Hazel et al. ..... 166/382
2005/0263279 A1 * 12/2005 Vachon ..... 166/250.01

* cited by examiner

*Primary Examiner*—Kenneth Thompson
*Assistant Examiner*—Sean D Andrish
(74) *Attorney, Agent, or Firm*—Buskop Law Group, PC; Wendy Buskop

(57) ABSTRACT

A system for controlling zones of fluid flow in and out of a wellbore. The wellbore has a top of a well and a bottom of a well. The system has a control line connected to a power source, and a control system; wherein the control line is disposed within the wellbore. The system also has a single fluid line sliding sleeve downhole tool assembly connected to the control line disposed within the wellbore.

41 Claims, 9 Drawing Sheets

SYSTEM FOR CONTROLLING ZONES OF FLUID IN AND OUT OF A WELLBORE

FIELD

The present embodiments generally relate to a single line sliding sleeve downhole tool assembly for drilling operations.

BACKGROUND

During production of hydrocarbons from a well, operators may find it necessary to either open a port within a tubular string or close a port within a tubular string. A valve placed in a tubular string can be used to establish communication with the reservoir, or alternatively, to shut-off communication with the reservoir. Several devices have been developed over the years to accomplish the opening and/or closing of ports within tubular strings.

These devices are generally known as sliding sleeves due to the ability of the devices to shift an inner sleeve from a first position to a second position. Sliding sleeves are commercially available from several vendors. One type of sliding sleeve that is commercially available is sold under the name "Otis DuraSleeve" and may be purchased from Hallibuiton Corporation.

A need exists for a system comprising two single line sliding sleeves downhole tools that can simultaneously activated with a single fluid source. There is further a need for a system where one zone can be simultaneously opened while another zone is simultaneously closed.

The present embodiments meet these needs.

BRIEF DESCRIPTION OF THE DRAWINGS

The detailed description will be better understood in conjunction with the accompanying drawings as follows.

DETAILED DESCRIPTION OF THE EMBODIMENTS

Figure 1:
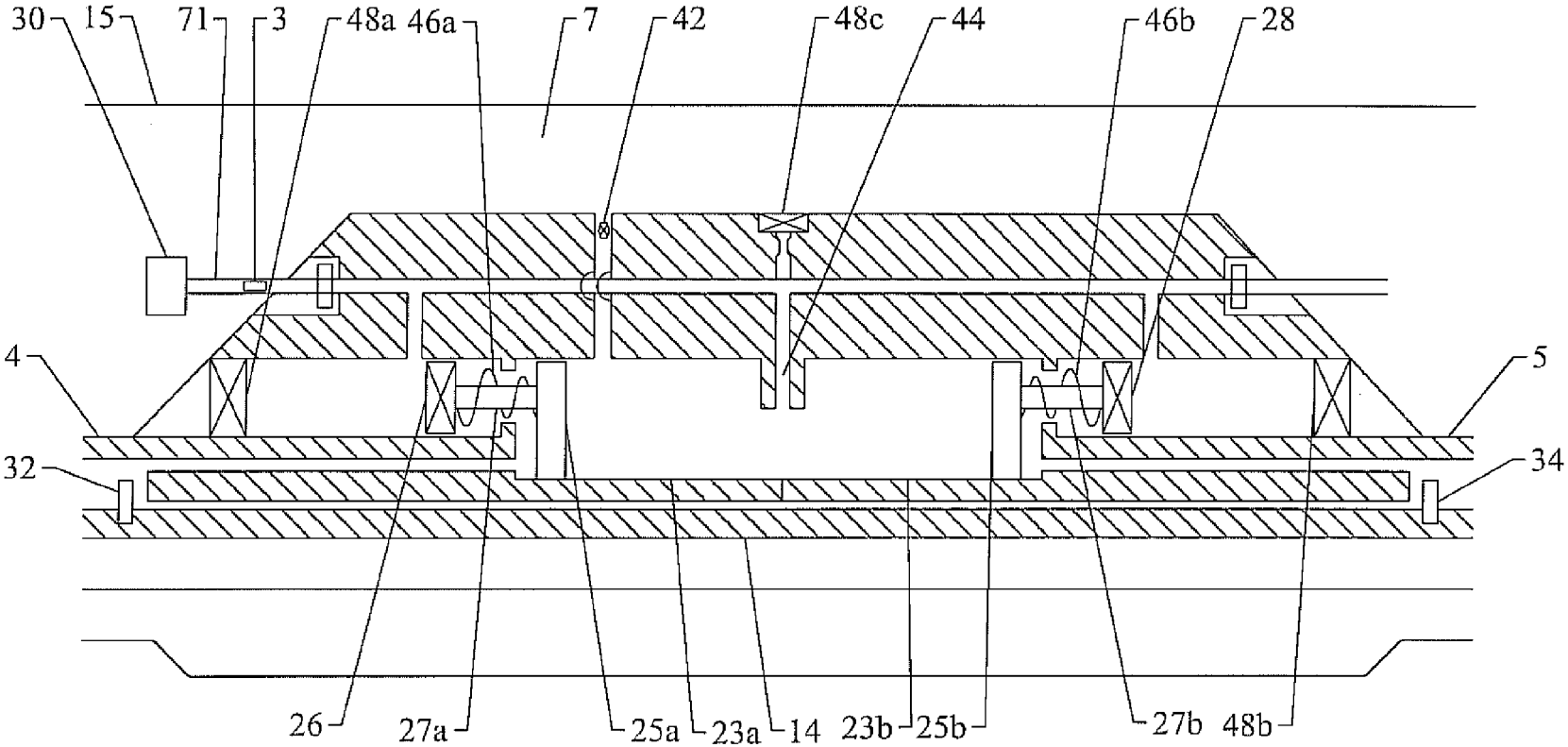
FIG. 1 depicts a cross sectional view of a central section of an embodiment of the present single line sliding sleeve downhole tool assembly.

Before explaining the present embodiments in detail, it is to be understood that the embodiments are not limited to the particular embodiments and that they can be practiced or carried out in various ways.

The present embodiments relate to a system for controlling zones of fluid flow in and out of a wellbore.

The system for controlling zones of fluid flow in and out of a wellbore. The wellbore has a top of a well and a bottom of a well. The system includes a control line connected to a power source, and a control system disposed in the wellbore.

The system further has a single fluid line sliding sleeve downhole tool assembly disposed within the wellbore, and connected to the control line. In an alternative embodiment of the system there can be two, three, or another plurality of single fluid sliding sleeves downhole tool assemblies.

A upper packer is disposed in the wellbore above the single fluid line sliding sleeve downhole tool assembly.

In the system a lower sealing means is disposed within the wellbore below the single fluid line sliding sleeve downhole tool assembly. Tubing is disposed in the wellbore between the upper packer and the top of the well.

In an embodiment of the system the lower sealing means can be a lower packer. In an alternative embodiment the lower sealing means can be a plug.

An embodiment of the system can further include a first system seal assembly. The first system seal assembly can be disposed between the upper packer and the top of the well. A second system seal assembly can be disposed between the lower sealing means and the bottom of the well.

The system can further have a safety valve disposed between the single fluid line sliding sleeve downhole tool assembly and the surface. A inner tubing string is connected to the tubing and located between the upper packer and the lower sealing means.

In an embodiment of the system, at least one reservoir filter can be disposed between the inner tubing string and the upper packer for each zone of fluid flow in the wellbore.

In an embodiment of the system, a tubing hanger can be disposed between the top of the well and the tubing 15. In another embodiment the system can be contained within casing.

The system relates to a method for controlling zones of fluid flow in and out of a wellbore. The method includes the step of running and setting an upper packer, and a lower sealing means simultaneously into a wellbore inside the casing 165. Then installing a control line, a tubing hanger, tubing, and at least one single fluid line sliding sleeve downhole tool assembly in the wellbore.

The method can further include running and setting a reservoir filter into the wellbore while running and setting the upper packer and lower sealing means. The step of installing a safety valve while installing the control line can also be performed.

An embodiment of the method can further include installing an inner tubing string while installing the control line.

The step of installing a power source and a control system to the control line can be performed after installing the control line.

The embodiments of the invention can be best understood with reference to the figures.

Figure 2:
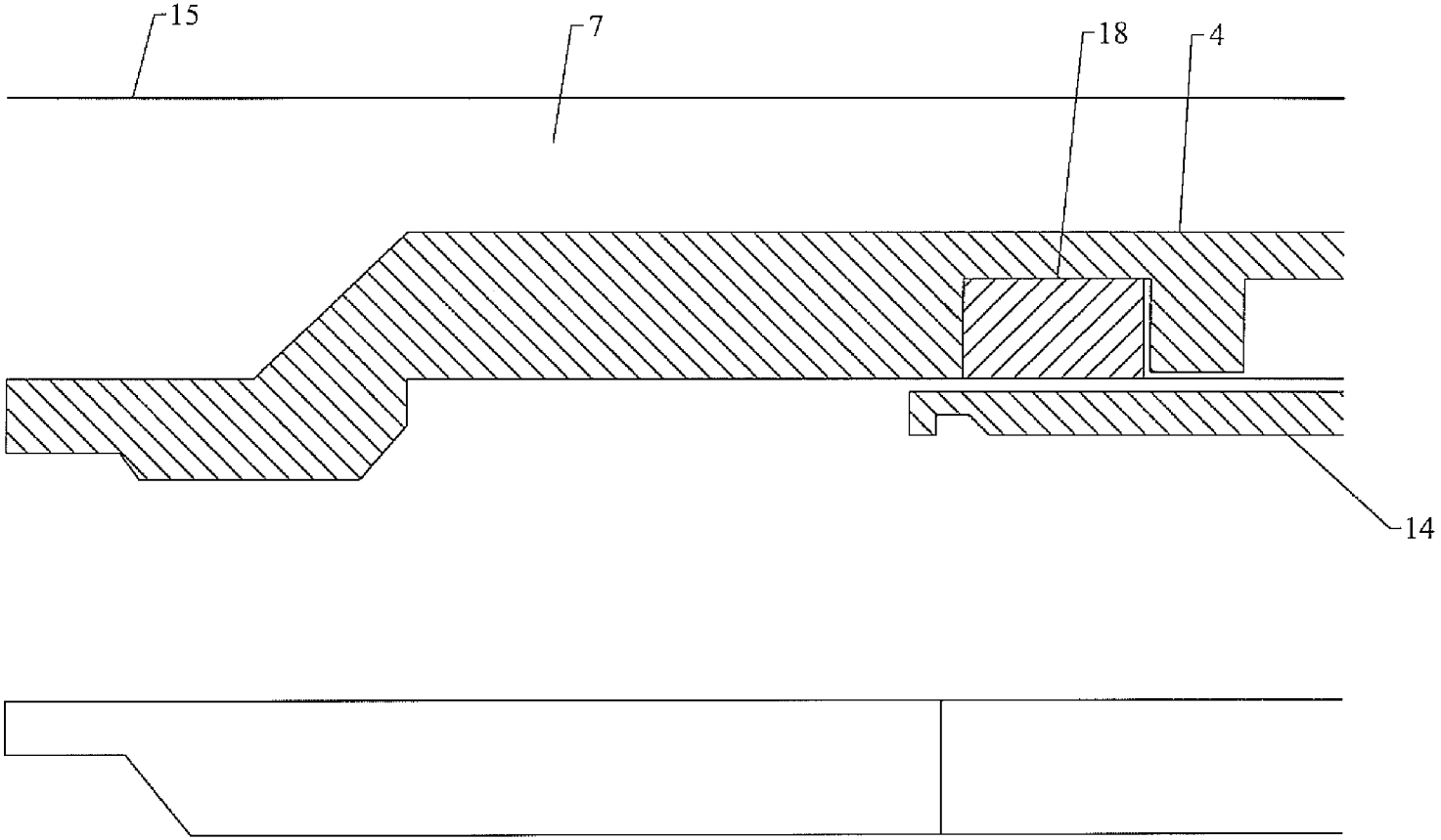
FIG. 2 depicts a cross sectional view of a top section of an embodiment of the present single line sliding sleeve downhole tool assembly.

Referring now to FIG. 1 a cross sectional view of an embodiment of a central section of the present single line sliding sleeve downhole tool assembly is depicted. A top connector 4 is depicted in communication with a body 6. The top connector can be a cylindrical threaded tubular member having a seal surface forming an inner diameter between 2.25 inches and 6.75 inches and an outer diameter between 2.5 and 7 inches. The top connector can made from carbon steel or another nickel alloy. The top connector can be between 1 foot and 4 feet long. In FIG. 2, the top connector 4 is further shown having an inner shoulder 69 creating an inner diameter between 0.25 inch and 0.5 inches in the top connector.

Returning to FIG. 1, the body 6 can be made from carbon steel or a nickel alloy steel. The body has an overall length ranging from one foot to ten feet. The body is generally tubular and cylindrical, but can be another shape than can run into a well, such as an oblong or elliptical shape. The body is contemplated to be mostly metal and have a tensile strength equal to or greater than tubing in the body.

An upper logic drum 23*a* and a lower logic drum 23*b* are disposed between the body 6 and a sleeve 14 for rotating and translating alternatingly between a first piston 26 and a second piston 28.

The first piston 26 is disposed in the body 6 and connected to a fluid source 30, such as a fluid reservoir, a pressurized tank, a hydraulic tank, or a similar fluid containment device. The communication is through a single fluid line 71. The first piston 26 can be made from steel, another elastomeric material or a nonelastomeric material which enables the piston to slide in the chamber. The pistons have an outer diameter ranging from 0.25 inches to 1.5 inches and an overall length ranging from 0.25 inches to 2 inches. The first piston 26 is connected to a first shaft 27*a*. The first shaft 27*a* can have be made from steel or another material. The shaft can have a cylindrical shape or another polygonal shape.

The first shaft 27*a* is connected to a first pin 25*a*. The first pin 25*a* can have a cylindrical shape, a conical shape, a cubic shape, a rectangular shape, or a substantially similar shape. The first pin can range from 0.25 inches to 2 inches in length and have a diameter between ranging from 0.125 inches to 1.5 inches. The pin can be solid or hollow.

A second piston 28 is disposed within the body 6 opposite the first piston 26. The second piston 28 is also connected to the fluid source 30. The fluid communication is the single fluid line 71.

The second piston 28 is secured to a second shaft 27*b*, which can be substantially similar to the first shaft 27*a*. The second shaft 27*a* is secured to second pin 25*b*, which can be substantially similar to the first pin 25*a*. The second pin 25*b* can also have a different shape than the first pin 25*a*. The first pin 25*a* engages the upper logic drum 23*a*, and the second pin 25*b* engages the lower logic drum 23*b*.

A first plug 48*a* separates the body 6 from an adjacent annulus 7. A second plug 48*b* on the opposite side of the body 6 also separates the body 6 from the annulus 7. The first plug 48*a* and the second plug 48*b* can be steel or another nonelastomeric material that prevents fluid from leaking out of the body or into the body, insuring the environmental compliance of the present tool assembly.

First plug 48*a* and second plug 48*b* provide a sealing engagement between the body 6 and the annulus 7. FIG. 1 also depicts a third plug 48*c*, separating the body 6 from the annulus 7, which can be substantially similar to first plug 48*a* and second plug 48*b*. It is also contemplated that first plug 48*a*, second plug 48*b*, and third plug 48*c* can be different types of plugs.

A valve 42 is depicted disposed within the body 6 between the body 6 and the annulus 7. An additional embodiment has the valve disposed between and the body 6 and the tubing. An additional embodiment has the valve disposed between and the body 6 and the surface via control line. The valve 42 can be operated to release pressure from within the body 6 created through the movement of first piston 26 and second piston 28. The valve 42 can be a check valve, or a check valve with a spring applying an additional force, such as part PRRA 2812080L from the Lee Company of Westbrook, Conn.

In an embodiment, valve 42 can be disposed between the body 6 and the tubing 15. This provides an advantage of reducing the time and costs associated with maintenance of valve 42.

A choke 44 is depicted disposed in the body 6 between the first piston 26 and the second piston 28. The choke 44 in one embodiment is a choke, such as the Visco Jet™ choke available also from the Lee Company as part number VHCA 1845112H. The choke 44 could also be pneumatic, or a combination of hydraulic and pneumatic chokes connected in series, wherein the chokes are connected to their respective fluid sources for supplying fluid. In an embodiment, fluid can be supplied from one fluid source to the first piston 26 and the second piston 28 as the pistons move.

FIG. 1 also depicts a first relocating device 46*a* disposed on the first shaft 27*a* for returning the first piston 26 from its secondary position to its original position. A second relocating device 46*b* is depicted disposed on the second shaft 27*b* for returning the second piston 26 from its secondary position to its original position.

The first relocating device 46*a* and the second relocating device 46*b* are depicted as springs, and can be coiled springs, wave springs, such as spring part number C075-H6 from Smalley of Chicago, Ill., or a nitrogen chamber, such as a nitrogen chamber made by the Petroquip Energy Services Company of Houston, Tex.

A fluid source 30 is in fluid communication with the first piston 26 and the second piston 28. A filter 3 is disposed between the fluid source and the first piston.

FIG. 2 depicts a cross sectional view of an embodiment of a top section of the present single line sliding sleeve downhole tool assembly.

A top sub 2, which can be made of carbon steel, or a nickel alloy, and can be made by PetroQuip Energy Services Company of Houston Tex., is depicted engaging the top connector 4.

A first seal assembly 18 is depicted providing a sealing engagement between the sleeve 14 and the top connector 4. The first seal assembly 18 can be any non elastomeric material.

Figure 3:
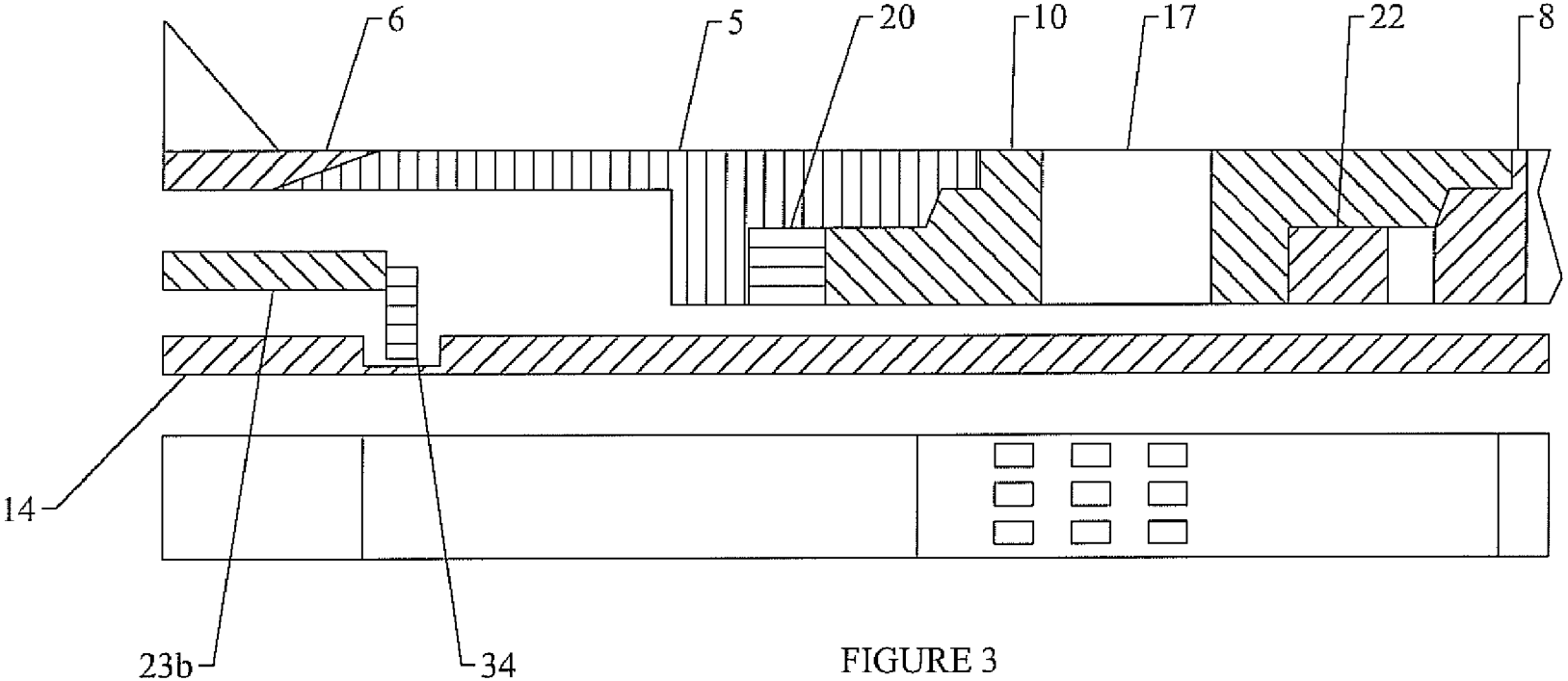
FIG. 3 depicts a cross sectional view of a mid-lower section of an embodiment of the present single line sliding sleeve downhole tool assembly.

FIG. 3 depicts a cross sectional view of an embodiment of a mid-lower section of the present single line sliding sleeve downhole tool assembly.

A middle connector 5 is between the body 6 and a port housing 10. The middle connector 5 can be made from steel or a nickel alloy. The port housing 10 can also be made from steel or nickel alloy, such as the port housing available from Petroquip Energy Services Company, and can be a tubular member having a length ranging from 12 inches to 24 inches.

The port housing 10 engages a lower connector 8. The lower connector 8 is a tubular member with a threaded engagement on each end. The lower connector 8 does not have an inner shoulder. The overall length of the lower connector 8 can range from 6 inches to 2 feet and can have an inner diameter range from 2.25 inches to 5.75 inches. The lower connector can be made from a carbon steel or a nickel alloy.

An annulus port 17 is disposed within the port housing 10. The annulus port 17 can have an outer diameter ranging from 3 inches to 7 inches, and an inner diameter ranging from 2.25 inches to 5.75 inches.

The annulus port 17 flows fluid, such as hydrocarbons or similar wellbore fluids from the annulus 7 to the production port 16, then to the tubing 15 and to the production line 90.

FIG. 3 depicts a second seal assembly 20, which provides a sealing engagement between a middle connector 5 and the sleeve 14.

A third seal assembly 22 is depicted for providing a sealing engagement between the port housing 10 and the sleeve 14. The second seal assembly 20 and the third seal assembly 22 can be substantially similar to the first seal assembly 18, depicted in FIG. 2, and can be best understood with reference to FIG. 8.

In another embodiment the second seal assembly 20 and the third seal assembly 22 can be different types of seals. For example, a second seal assembly can be made from Teflon™, available from DuPont of Wilmingdton, Del., and a third seal assembly can be made from PEEK™ (polyester ester ketone), also made by Dupont.

In another embodiment, the second seal assembly can be made from a blend of a 95% PEEK and 5% Viton™ from Dupont.

The lower logic drum 23*b* is depicted in an operative position, secured to the sleeve 14 with a second fastener 34. The first fastener 32, depicted in FIG. 1, and the second fastener 34, shown in FIG. 3, work in concert to connect the upper logic drum 23*a* and the lower logic 23*b* to the sleeve 14. The first fastener 32 and the second fastener 34 can be a snap ring that captures the upper and lower logic drums 23*a* and 23*b* relative to the sleeve 14. The fasteners can be snap rings from Smalley, shear pins, shear screws, locking dogs, or combinations thereof.

Figure 4:
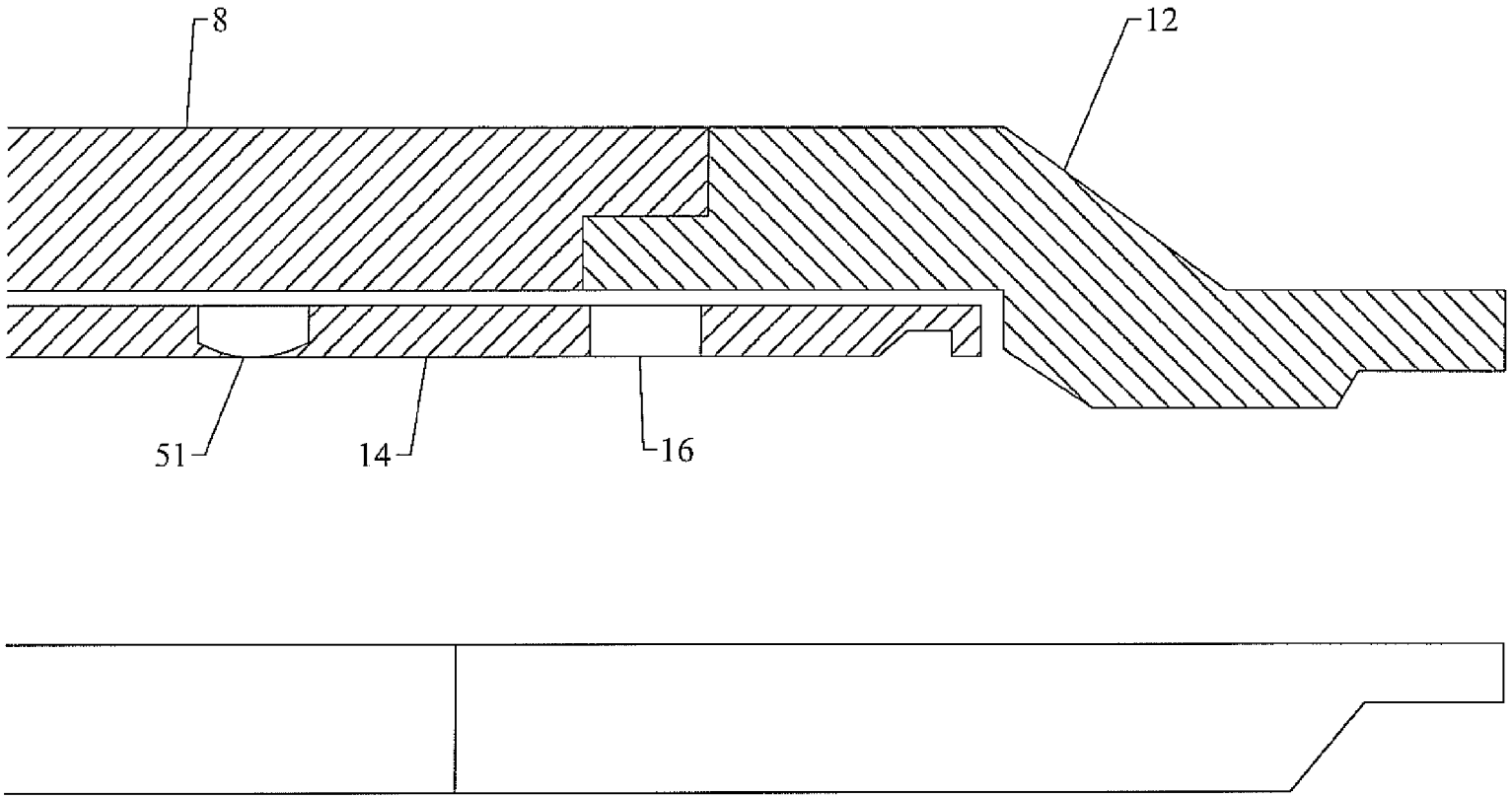
FIG. 4 depicts a cross sectional view of a bottom section of an embodiment of the present single line sliding sleeve downhole tool assembly.

Referring now to FIG. 4, a cross sectional view of an embodiment of a bottom section of the present single line sliding sleeve downhole tool assembly is depicted. The sleeve 14 is depicted in an operative arrangement with a production port 16 for axially moving with respect to lower connector 8. The lower connector 8 is shown engaging a bottom sub 12. Production port 16 allows a flow area equal to or greater than the flow area of the tubing 15.

The production port 51, which can have a diameter ranging from 0.025 inches to 3 inches is depicted. When the single line sliding sleeve assembly is in a closed position the production port 51 and the production port 16 are isolated from the annulus port 17, and when in the open position the annulus port 17 and the production port 51 are aligned so that the annulus 7 and the sleeve 14 are in communication.

Figure 5A:
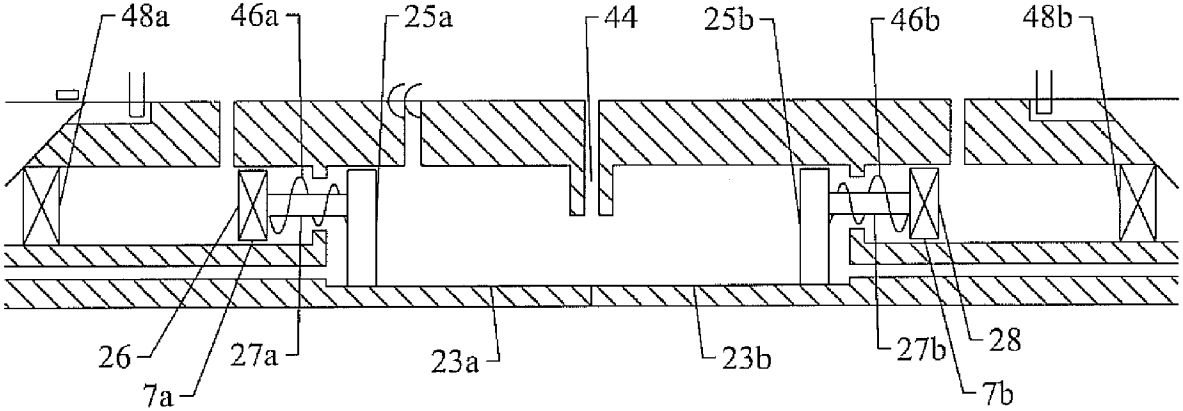
FIG. 5A depicts a cross sectional view of an embodiment of the present single line sliding sleeve downhole tool assembly showing a piston in its original position.

Referring now to FIG. 5*a*, the first piston 26 is depicted within the body 6 in its original position. The first relocating device 46*a* is depicted extended. The second piston 28 is further depicted in its original position with second relocating device 46*b* extended.

Figure 5B:
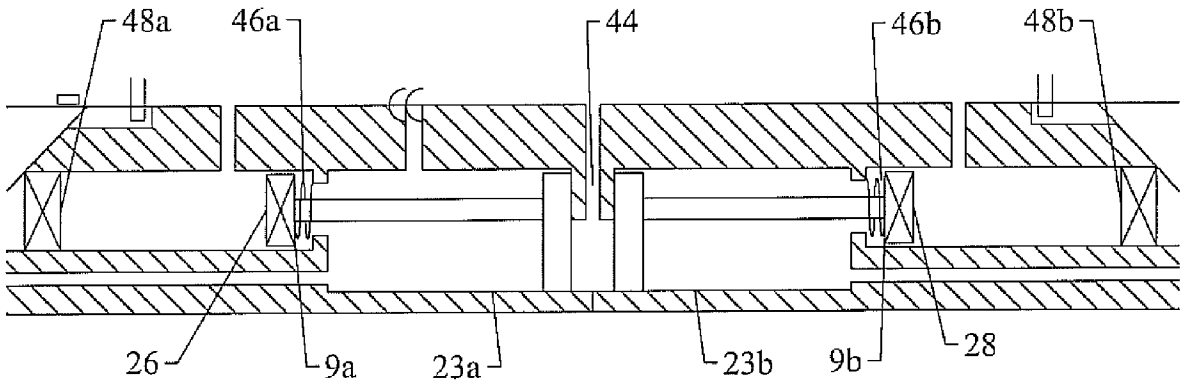
FIG. 5B depicts a cross sectional view of an embodiment of the present single line sliding sleeve downhole tool assembly showing a piston in its secondary position.

FIG. 5*b* depicts the first piston 26 after the first piston 26 has moved axially within the body 6, achieving its secondary position. The first relocation device 46*a* is depicted compressed. The second piston 28 is further depicted its secondary position 9*b*, with second relocating device 46*b* compressed.

Figure 6:
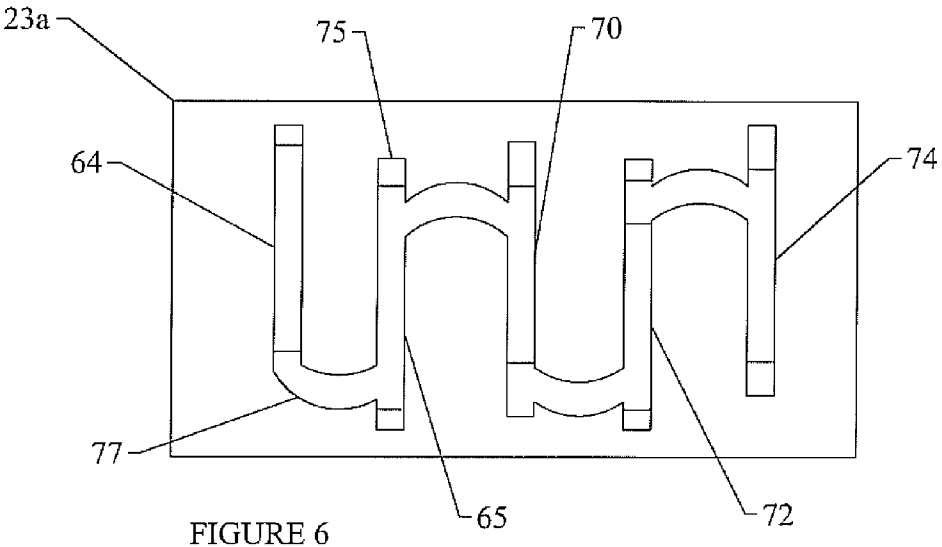
FIG. 6 is an unfolded view of an embodiment of the logic drum.
Figure 7:
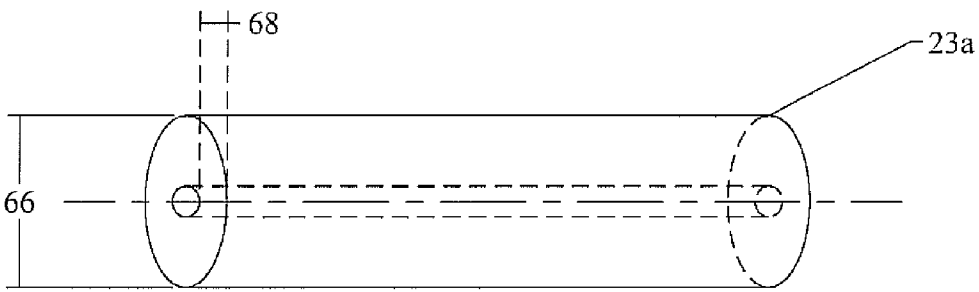
FIG. 7 is an isometric view of the embodiment of the logic drum

An embodiment of the upper logic drum 23*a* is depicted in a unfolded view in FIG. 6 and an isometric view in FIG. 7. The upper logic drum 23*a* can have an overall diameter 66 ranging from 2.8 inches to 5.5 inches. The upper logic drum 23*a* can have a wall thickness 68 ranging from 0.125 inches to 0.5 inches. The upper logic drum 23*a* has at least two positioning slots.

In FIG. 6, a plurality of positioning slots 64, 65, 70, 72, 74 are disposed within the wall of the upper logic drum 23*a*. The positioning slots 64, 65, 70, 72, 74 can range from 25% to 75% of the length of the upper logic drum 23*a*. The upper logic drum 23*a* can have a length ranging from 8 inches to 60 inches. The positioning slots 64, 65, 70, 72, 74 can have a J shape. In an embodiment, the positioning slots can have a landing slot 75 and a rotation slot 77. The positioning slots 64, 65, 70, 72, 74 engage the pins to land within the landing slots 75 and remove torque. The positioning slots 64, 65, 70, 72, 74 can vary in length. The pins engage these slots for positioning the sleeve 14.

Figure 8:
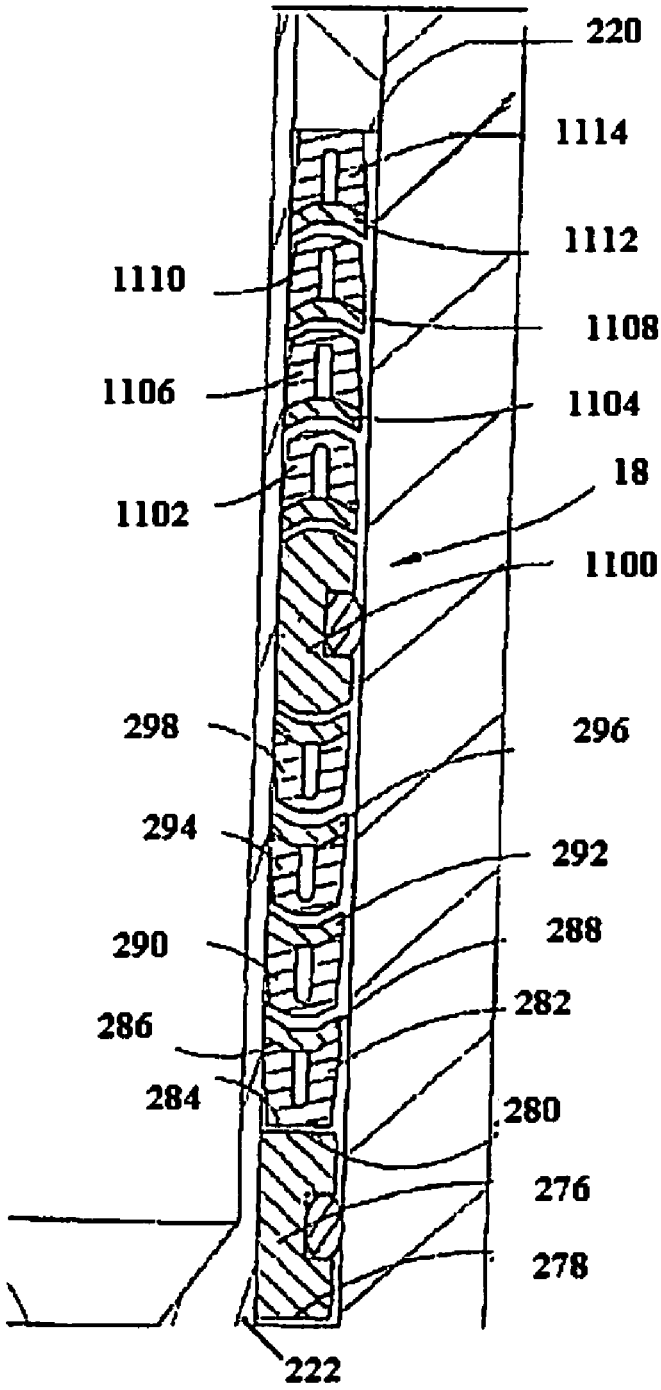
FIG. 8 is a cross sectional view of a system seal assembly.

Referring now to FIG. 8, an exemplary system seal assembly 18 is depicted. The system seal assembly 18 comprises an equalizing seal means 276, wherein the equalizing seal means 276 can be constructed of filled PEEK, which is commercially available from Green Tweed under the name Arlon™. The PEEK has a tensile strength greater than 25,000 psi at 70 degrees F., and 13,000 psi at 350 degrees F. All seal means of the seal assembly 18 may be constructed of any equivalent type of material, such as Teflon, made by the DuPont Corporation.

An end 278 of the equalizing seal means 276 abuts the radial shoulder 222 and the opposite end 280 abuts the header seal ring means 282. The header seal means 282 can be constructed of filled PEEK. The header seal means 282 has a first end 284 and a second angled end 286. A non-extrusion ring 288 is included, which can be constructed of filled PEEK. The non-extrusion ring 288 comprises a concave shape and can prevent the extrusion and bulging of the ring members on either side.

The seal assembly 18 can further comprise a first seal ring means 290. The seal ring means 290 can constructed of filled PEEK. A second non-extrusion ring 292 can be provided, which in turn leads to a second seal ring means 294. A third non-extrusion ring 296 is also shown which leads to a third seal ring means 298. The seal assembly 18 can also include a follower seal ring 1100, which can be constructed of filled PEEK. The follower seal ring 1100 has a first and second curved surface. A fourth seal ring means 1102 can be included wherein one end abuts the follower seal ring 1100 and the other end abuts a non-extrusion ring 1104.

A fifth seal ring means 1106 is provided that will in turn abut the non-extrusion ring 1108. The non-extrusion ring 1108 will then abut the sixth seal ring means 1110 that in turn will abut the non-extrusion ring 1112. The non-extrusion ring 1112 will abut the header seal ring 1114. The header seal ring 1114 will have an angled end abutting the back side of the non-extrusion ring 1108, and a second radially flat end that will abut the radial end 220.

Figure 9A:
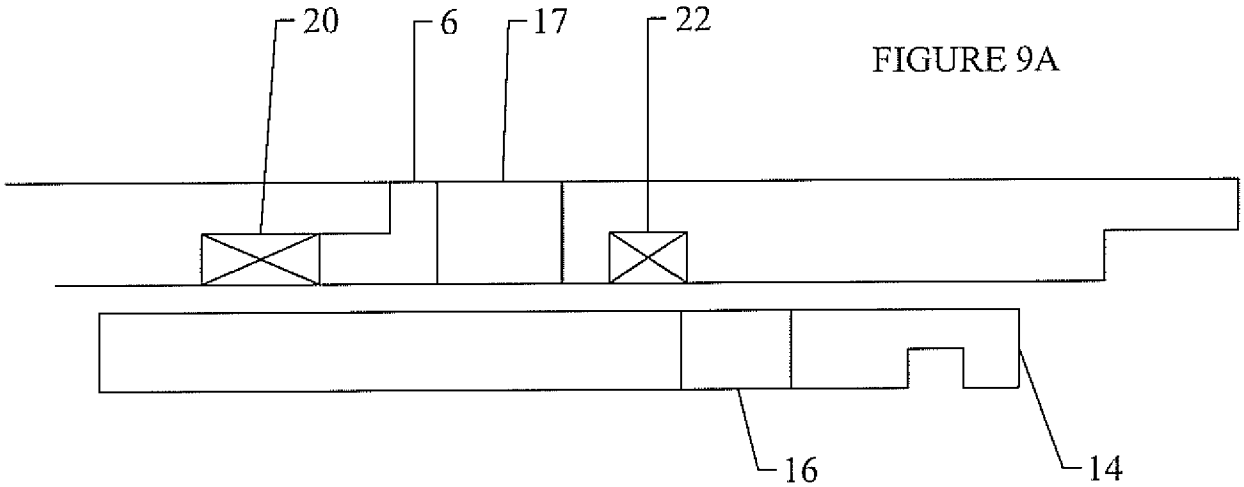
FIG. 9A is a cross sectional view of the sleeve of the present single line sliding sleeve downhole tool assembly in a closed position.

FIG. 9A depicts production port 16 disposed beneath third seal assembly 22, misaligned from annulus port 17, thereby preventing fluid from flowing through production port 16.

Figure 9B:
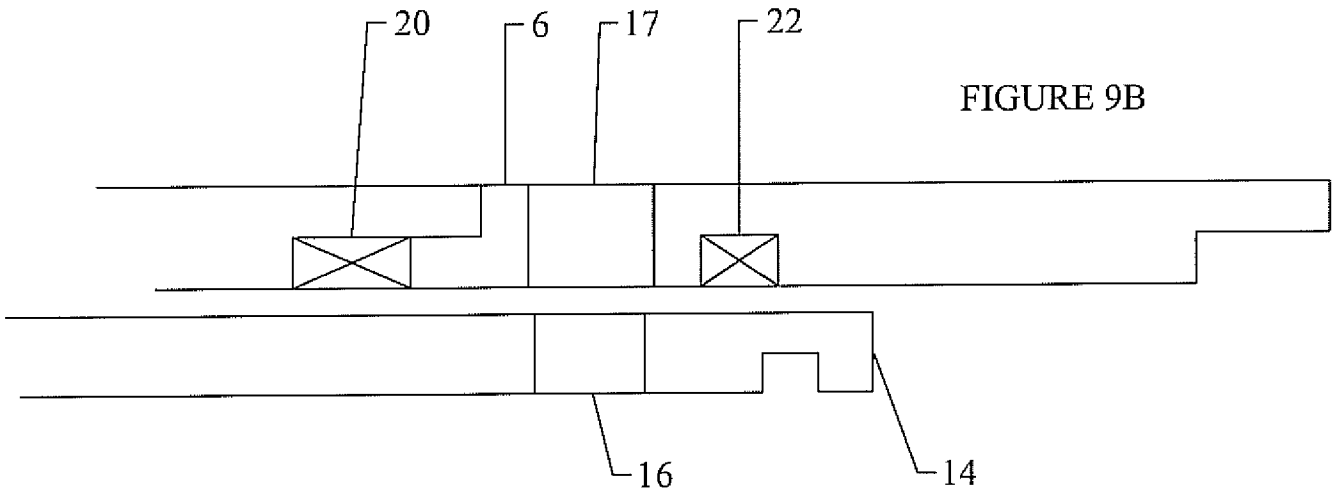
FIG. 9B is a cross sectional view of the sleeve of the present single line sliding sleeve downhole tool assembly in an open position.

FIG. 9B depicts a cross sectional view of the single fluid line sliding sleeve downhole tool assembly depicted in FIG. 7*a* after sleeve 14 has moved axially into an open position.

Production port 16 of sleeve 14 is depicted in alignment with annulus port 17 of body 6, allowing fluid to flow through the aligned ports.

Figure 10:
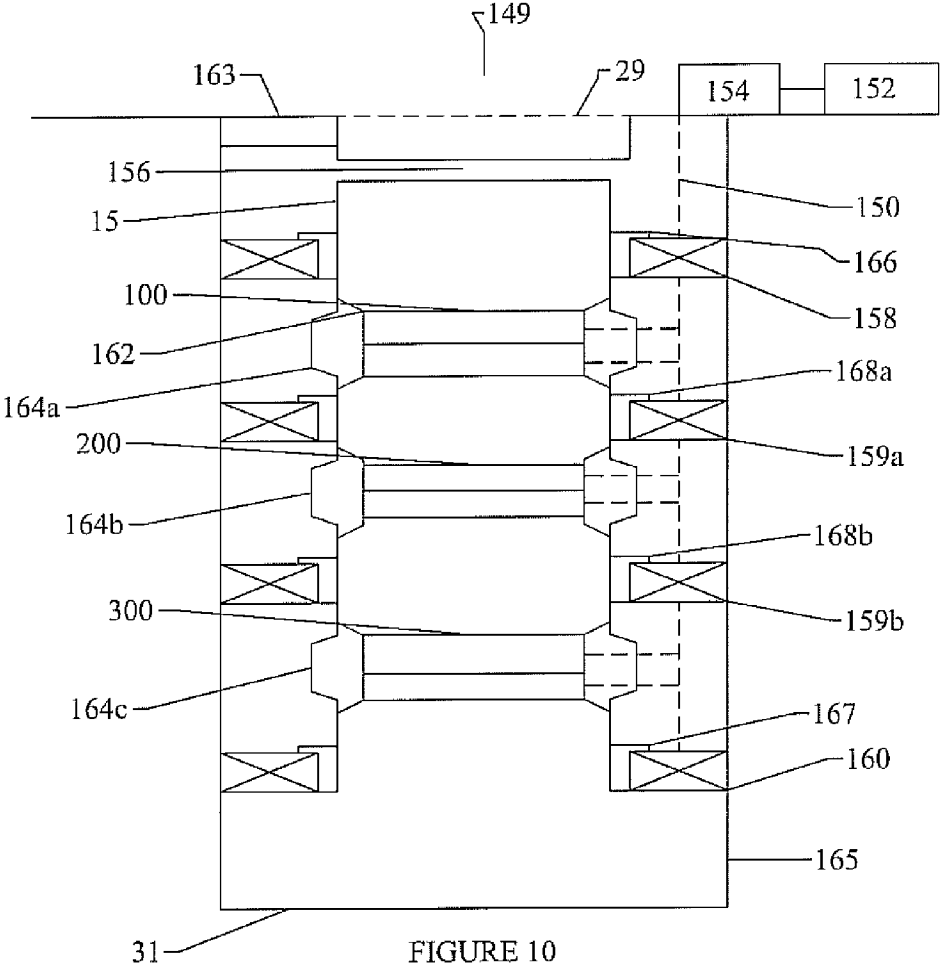
FIG. 10 is a schematic of an embodiment of the system for controlling zones of fluid flow in and out of a wellbore wherein multiple single fluid line sliding sleeves are connected in series.

FIG. 10 is a schematic of the system 149. The system is depicted having a control line 150 connected to a power source 152. A first group 100 is disposed between an upper packer 158 and a middle packer 159*a*. The group 100 can be a plurality of single sleeve downhole tool assembles connected in series are in parallel, the single sleeve downhole tool assembly is depicted in more detail in FIGS. 1-9.

The group 100 is disposed between an upper packer 158 and a middle packer 159*a*. A second group, which is similar to the first group, is disposed below the first group between the middle packer 159*a* and a second middle packer 159*b*. A third group 300 is disposed between the second middle packer 159*b* and the lower sealing means 160.

A first system seal assembly 166 is disposed between the upper packer 158 and the top of the well 29. A second seal assembly 167 is disposed between the lower packer and the bottom of the well 31. A third system seal assembly 168*a* and a fourth system seal assembly 168*b* is disposed between each middle packers 159*a* and 159*b*, and the first group 100 and the second group 200.

A control system 154 is used to simultaneously operate each of the groups 100, 200, and 300. The control system 154 can be an automated control system, such as the one sold by WellDynamics Inc, located in Spring Tex., EP-solutions located in Kingwood, Tex.; a mechanical control system, or a substantial similar control system. A safety valve 156 can be disposed between the tool assembly and the top of the well. The safety valve 156 can be purchased from Weatherford or Schlumberger.

A tubing hanger 163 is disposed between the top of the well and the tubing 15. A inner tubing string 162, such as one available from Grant Prideco, is connected to the tubing 15, and located between the upper packer 158 and the lower sealing means 160.

A first zone is between the upper packer 158 and packer 159*a*, the second zone is between the between 159*a* and 159*b*. A third zone is between the packer 159*b* and the lower sealing means 160. The entire system is stored within a casing 165. The lower sealing means 160 can be a lower packer or a plug.

A first reservoir filter 164*a*, a second reservoir filter 164*b*, and a third reservoir filter 164*c* are disposed between the inner tubing string 162 and the lower sealing means and between each zone. The lower reservoir filter can be a well screen available form Houston screens, located in Houston Tex.

While these embodiments have been described with emphasis on the embodiments, it should be understood that within the scope of the appended claims, the embodiments might be practiced other than as specifically described herein.

The invention claimed is:

1. A system for controlling zones of fluid flow in and out of a wellbore having a top of a well and a bottom of a well, the system comprising:

a single fluid control line disposed in the wellbore and connected to a power source and a control system;

a single fluid line sliding sleeve downhole tool assembly disposed within the wellbore, wherein the single fluid line sliding sleeve downhole tool assembly is connected to the single fluid control line;

an upper packer disposed in the wellbore above the single fluid line sliding sleeve downhole tool assembly engaging the single fluid control line;

a lower sealing means in the wellbore disposed below the single fluid line sliding sleeve downhole tool assembly; and tubing disposed in the wellbore between the upper packer and the top of the well, wherein fluid from the single fluid control line discharges to an adjacent annulus.

2. The system of claim 1, wherein the lower sealing means comprises a lower packer or a plug.

3. The system of claim 1, further comprising:

a first system seal assembly that engages a top packer; and a second system seal assembly that engages the lower sealing means.

4. The system of claim 1, further comprising a safety valve disposed between the upper packer and the surface.

5. The system of claim 1, further comprising an inner tubing string connected to the tubing and located between the upper packer and the lower sealing means.

6. The system of claim 5, further comprising at least one reservoir filter disposed between the upper packer and the lower sealing means.

7. The system of claim 1, further comprising a tubing hanger disposed between the top of the well and the tubing.

8. The system of claim 1, wherein the system is contained within casing.

9. The system of claim 1, wherein at least one single fluid line sliding sleeve downhole tool assembly of a plurality of single fluid line sliding sleeve downhole tool assemblies comprises:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source and wherein the first piston moves axially between at least an original position and at least a secondary position;

a second piston in communication with the fluid source and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a valve disposed within the single fluid control line; and a first relocating device for relocating the first piston from the secondary position to the original position and a second relocating device for relocating the second piston from the second piston secondary position to the second piston original position.

10. A method for controlling zones of fluid flow in and out of a wellbore, wherein the wellbore has a top of a well and a bottom of a well, the method comprising:

running and setting an upper packer, and a lower sealing means simultaneously into a wellbore inside casing; and installing a single fluid control line, a tubing hanger, a tubing, and engaging the single fluid control line, and at least two single fluid line sliding sleeve downhole tool assemblies in the wellbore with the single fluid control line, wherein each single fluid line sliding sleeve downhole tool assembly of the at least two single fluid line sliding sleeve downhole tool assemblies is in communication with the single control line, and wherein fluid from the single fluid control line discharges to an adjacent annulus.

11. The method of claim 10, further comprising running and setting a reservoir filter into the wellbore while running and setting the upper packer and the lower sealing means.

12. The method of claim 10, further comprising installing a safety valve while installing the single fluid control line.

13. The method of claim 10, further comprising installing an inner tubing string while installing the single fluid control line.

14. The method of claim 10, further comprising installing a power source and a control system to the control line after installing the single fluid control line.

15. The method of claim 10, wherein at least one single fluid line sliding sleeve downhole tool assembly of the at least two single fluid line sliding sleeve downhole tool assemblies comprises:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source and wherein the first piston moves axially between at least an original position and at least a secondary position;

a second piston in communication with the fluid source and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a first relocating device for relocating the first piston from the secondary position to the original position and a second relocating device for relocating the second piston from the second piston secondary position to the second piston original position.

16. A system for controlling zones of fluid flow in and out of a wellbore having a top of a well and a bottom of a well, wherein the system comprises:

a single fluid control line disposed in the wellbore and connected to a power source and a control system;

at least two operably connected single fluid line sliding sleeve downhole tool assemblies connected to the single fluid control line disposed within the wellbore;

an upper packer within the wellbore disposed above the at least two operably connected single fluid line sliding sleeve downhole tool assemblies engaging the single fluid control line;

a lower sealing means within the wellbore disposed below the at least two operably connected single fluid line sliding sleeve downhole tool assemblies;

at least one middle packer within the wellbore disposed between the at least two operable connected single fluid line sliding sleeve downhole tool assemblies; and tubing disposed in the wellbore between the upper packer and the top of the well, wherein fluid from the single fluid control line discharges to an adjacent annulus.

17. The system of claim 16, wherein the lower sealing means is a lower packer or a plug.

18. The system of claim 16, further comprising:

a first system seal assembly that engages the upper packer;

a second system seal assembly that engages the lower sealing means; and at least one third system seal assembly that engages each middle packer.

19. The system of claim 16, further comprising multiple single fluid line sliding sleeve downhole tool assemblies operably connected together.

20. The system of claim 19, wherein each of the single fluid line sliding sleeve downhole tool assemblies are connected in series.

21. The system of claim 19, wherein each of the single fluid line sliding sleeve downhole tool assemblies are connected to at least two parallel groups of fluid lines from the single fluid line, and wherein each parallel group is connected in series along the single fluid line.

22. The system of claim 16, further comprising a safety valve disposed between the top of the well and the upper packer.

23. The system of claim 16, further comprising an inner tubing string connected to the tubing and located between the upper packer and the lower sealing means.

24. The system of claim 16, further comprising at least one reservoir filter disposed between an inner tubing string and the upper packer for each zone of fluid flow in the wellbore.

25. The system of claim 16, further comprising a tubing hanger disposed between the top of the well and the tubing.

26. The system of claim 16, wherein the system is contained in casing.

27. The system of claim 16, wherein the at least one of the at least two operably connected single line sliding seal downhole tool assemblies comprises:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source through a single fluid line and wherein the first piston moves axially between at least an original position and at least a secondary position;

a second piston in communication with the fluid source, and wherein the second piston moves axially between at least a second piston original position and at least a second piston secondary position, and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a valve disposed within the control fluid line; and a first relocating device for relocating the first piston from the secondary position to the original position and a second relocating device for relocating the second piston from the second piston secondary position to the second piston original position.

28. A system for controlling zones of fluid flow in and out of a wellbore having a top of a well and a bottom of a well the system comprising:

a single fluid control line disposed within the wellbore and connected to a power source and a control system;

at least two operably connected in series groups of single fluid line sliding sleeve downhole tool assemblies, each group comprising a plurality of serially connected single fluid line sliding sleeve downhole tool assemblies connected to the single fluid control line disposed within the wellbore, and wherein fluid from the single fluid control line discharges to an adjacent annulus;

an upper packer in the wellbore disposed above the groups of single fluid line sliding sleeve downhole tool assemblies;

a lower sealing means in the wellbore disposed below the groups of single fluid line sliding sleeve downhole tool assemblies;

at least one middle packer in the wellbore disposed between the groups of single fluid line sliding sleeve downhole tool assemblies; and tubing disposed in the wellbore between the upper packer and the top of the well.

29. The system of claim 28, further comprising:

a first system seal assembly that engages the upper packer;

a second system seal assembly that engages the lower sealing means; and at least one third system seal assembly that engages each middle packer.

30. The system of claim 28, further comprising a safety valve disposed between the top packer and the top of the well.

31. The system of claim 28, further comprising an inner tubing string connected to the tubing and located between the upper packer and the lower sealing means.

32. The system of claim 31, further comprising at least one reservoir filter disposed between the packers for each zone of fluid flow in the wellbore.

33. The system of claim 28, further comprising a tubing hanger disposed between the top of the well and the tubing.

34. The system of claim 28, wherein the system is contained in casing.

35. The system of claim 28, wherein at least one single fluid line sliding sleeve downhole tool assembly of the at least two operably connected in series groups of single fluid line sliding seal downhole tool assemblies comprise:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source through a single fluid line wherein the first piston moves axially between at least an original position and at least a secondary position;

a second piston in communication with the fluid source and wherein the second piston moves axially between at least a second piston original position and at least a second piston secondary position, and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a valve disposed within the single control fluid line; and a first relocating device for relocating the first piston from the secondary position to the original position and a second relocating device for relocating the second piston from the second piston secondary position to the second piston original position.

36. A method for controlling zones of fluid flow in and out of a wellbore, wherein the wellbore has a top of a well and a bottom of a well, wherein the method comprises:

running and setting an upper packer and a lower sealing means simultaneously into a wellbore with casing; and installing a single fluid control line, tubing hanger with tubing, and at least one group of single fluid line sliding sleeve downhole tool assemblies, wherein each single fluid line sliding sleeve downhole tool assembly of the at least one group of single fluid line sliding sleeve downhole tool assemblies is in communication with the single fluid control line, and wherein the fluid from the single fluid control line discharges to an adjacent annulus.

37. The method of claim 36 further comprising running and setting a reservoir filter when the upper packer is run and set.

38. The method of claim 36 further comprising installing a safety valve while installing the single fluid control line.

39. The method of claim 36, further comprising installing at least one system seal assembly and an inner tubing string while installing the single fluid control line.

40. The method of claim 36, further comprising installing a power source and a control system to the single fluid control line while installing the single fluid control line.

41. The method of claim 36, wherein the at least one group of single fluid line sliding sleeve downhole tool assemblies comprises a plurality of single fluid line sliding sleeve downhole tool assemblies comprising:

a top sub engaging a top connector which connects to a body that engages a middle connector which is secured to a port housing, wherein the port housing engages a lower connector and the lower connector engages a bottom sub;

a sleeve with a production port for axially moving with respect to the body;

an annulus port disposed in the port housing for communicating fluid between an annulus and tubing in the sleeve;

a first seal assembly providing a sealing engagement between the sleeve and the top connector;

a second seal assembly providing a sealing engagement between the middle connector and the sleeve;

a third seal assembly providing a sealing engagement between the port housing and the sleeve;

a first piston in communication with a fluid source through a single fluid line and wherein the first piston moves axially between at least an original position and at least a secondary position;

a second piston in communication with the fluid source, and wherein the second piston moves axially between at least a second piston original position and at least a second piston secondary position; and wherein the first piston moves the sleeve in a first direction and the second piston moves the sleeve in a second direction;

at least one logic drum linearly disposed between the body and the sleeve for rotating and translating alternatingly between the first piston and the second piston;

a means for actuating the first piston and the second piston;

a first relocating device for relocating the first piston from the secondary position to the original position and a second relocating device for relocating the second piston from the second piston secondary position to the second piston original position.

* * * * *